US007950760B2

(12) United States Patent
Takeuchi

(10) Patent No.: US 7,950,760 B2
(45) Date of Patent: May 31, 2011

(54) LIQUID DROPLET EJECTING APPARATUS AND LIQUID DROPLET EJECTING METHOD

(75) Inventor: Yoshio Takeuchi, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 438 days.

(21) Appl. No.: 12/209,383

(22) Filed: Sep. 12, 2008

(65) Prior Publication Data

US 2009/0073207 A1 Mar. 19, 2009

(30) Foreign Application Priority Data

Sep. 18, 2007 (JP) ..... 2007-240695

(51) Int. Cl.
*B41J 2/205* (2006.01)

(52) U.S. Cl. ..... 347/10; 347/11

(58) Field of Classification Search ..... 347/10, 347/11

See application file for complete search history.

(56) References Cited

U.S. PATENT DOCUMENTS

| | | | | |
|---|---|---|---|---|
| 6,435,666 | B1 * | 8/2002 | Trauernicht et al. | 347/54 |
| 2004/0146055 | A1 | 7/2004 | Trauernicht et al. | |
| 2006/0125856 | A1 | 6/2006 | Kitami et al. | |
| 2006/0284913 | A1 | 12/2006 | Takanose et al. | |

FOREIGN PATENT DOCUMENTS

| | | | |
|---|---|---|---|
| EP | 1 433 610 | A2 | 6/2004 |
| EP | 1 717 046 | A1 | 11/2006 |
| JP | 2002-19103 | A | 1/2002 |

OTHER PUBLICATIONS

Extended European Search Report dated Jan. 15, 2009, 7 pages, issued in counterpart European Application No. EP 08252995.9-1251.

* cited by examiner

*Primary Examiner* — Laura E Martin

(74) *Attorney, Agent, or Firm* — Holtz, Holtz, Goodman & Chick, PC

(57) ABSTRACT

A liquid droplet ejecting apparatus having: a liquid droplet ejecting head; and a drive pulse generating unit, wherein the head includes: a nozzle; a pressure chamber which communicates with the nozzle; and a pressure applying section which changes a pressure in the pressure chamber, wherein the generated drive pulse is applied to the pressure applying section so as to change the pressure in the pressure chamber to cause the liquid in the pressure chamber to be ejected from the nozzle, and wherein the drive pulse includes a rectangular expansion pulse which causes expansion and then contraction of the volume of the pressure chamber and in which the pulse width PW of the expanding pulse is set so as to satisfy the following conditional equation, $$PW = \frac{\pi - \left(\tan^{-1}\frac{1}{2\pi f \tau}\right)}{2\pi f} \quad (1)$$

where f represents an acoustic resonance frequency of a pressure wave in the pressure chamber and τ represents a damping time constant of the pressure wave.

16 Claims, 6 Drawing Sheets

LIQUID DROPLET EJECTING APPARATUS AND LIQUID DROPLET EJECTING METHOD

BACKGROUND OF THE INVENTION

1. Field of the Invention

The present invention relates to a liquid droplet ejecting apparatus and a liquid droplet ejecting method.

2. Description of Related Art

In the liquid droplet ejecting head in which liquid droplets are ejected from a nozzle such as an inkjet recording head (also called recording head hereinafter) for recording images using small ink droplets, liquid droplets are ejected from the nozzle and land on a recording medium such as recording paper and the like by applying pressure to a pressure chamber.

There are various pressure application methods for applying pressure in the pressure chamber, and as disclosed in Patent Document 1, one example is the type in which ink droplet ejection pressure is obtained by using a piezoelectric element.

In the past, in the case where the ink droplets were ejected from the nozzle by increasing the pressure in the pressure chamber by expanding and then contracting the volume of the pressure chamber, the pulse width of the expansion pulse for expanding and then contracting the volume in the pressure chamber was considered to be capable of ejecting most effectively when equal to 1 AL (Acoustic Length), and so this has been used. (See Unexamined Japanese Patent Application No. 2002-19103 publication). The "AL" is a unit of time and 1 AL corresponds to ½ of the acoustic resonance period of the pressure chamber.

However, according to the findings of the inventors, the negative pressure wave that is generated by the expansion dampens with the passage of time when it propagates through the pressure chamber. As a result, it was determined that when damping of the pressure wave is considered, if the pulse width of the expanding pulse is set shorter than 1 AL to which it is set in the aforementioned prior art, ejection can be more efficient.

As is the case in the prior art, when the pulse width of the expanding pulse is set to 1 AL, at the point where the positive pressure exceeds the maximum (peak) and is decreasing, removing application of the expansion pulse is carried out and ejection efficiency is reduced.

SUMMARY

The present invention was conceived in view of the aforementioned problems and the object thereof is to provide a liquid droplet ejecting apparatus and liquid droplet ejecting method which can eject liquid droplets with higher efficiency.

According to one aspect of the present invention, there is provided a liquid droplet ejecting apparatus comprising: a liquid droplet ejecting head; and a drive pulse generating unit adapted to generate a drive pulse, wherein the liquid ejecting head includes: a nozzle which ejects liquid droplets; a pressure chamber which communicates with the nozzle; and a pressure applying section which changes a pressure in the pressure chamber by expanding or reducing a volume of the pressure chamber, wherein the drive pulse generated by the drive pulse generating unit is applied to the pressure applying section so as to change the pressure in the pressure chamber and the change of pressure in the pressure chamber causes the liquid in the pressure chamber to be ejected from the nozzle, and wherein the drive pulse comprises a rectangular expansion pulse which causes expansion and then contraction of the volume of the pressure chamber and in which a pulse width PW of the expanding pulse is set so as to satisfy the following conditional equation, $$PW = \frac{\pi - \left(\tan^{-1}\frac{1}{2\pi f \tau}\right)}{2\pi f} \tag{1}$$

where f represents an acoustic resonance frequency of a pressure wave in the pressure chamber and $\tau$ represents a damping time constant of the pressure wave.

According to another aspect of the present invention, there is provided the liquid droplet ejecting apparatus described above, wherein the damping time constant $\tau$ is not less than $8\times10^{-6}$ (sec) and not more than $100\times10^{-6}$ (sec).

According to still another aspect of the present invention, there is provided the liquid droplet ejecting apparatus described above, wherein the drive pulse further comprises a rectangular contraction pulse that follows the rectangular expansion pulse and causes contraction and then expansion of the volume of the pressure chamber.

DESCRIPTION OF THE PREFERRED EMBODIMENTS

The following is a description of the embodiments of the present invention, but aspects of this invention are not to be limited by these embodiments.

The embodiments of the present invention will be described using the drawings.

Figure 1:
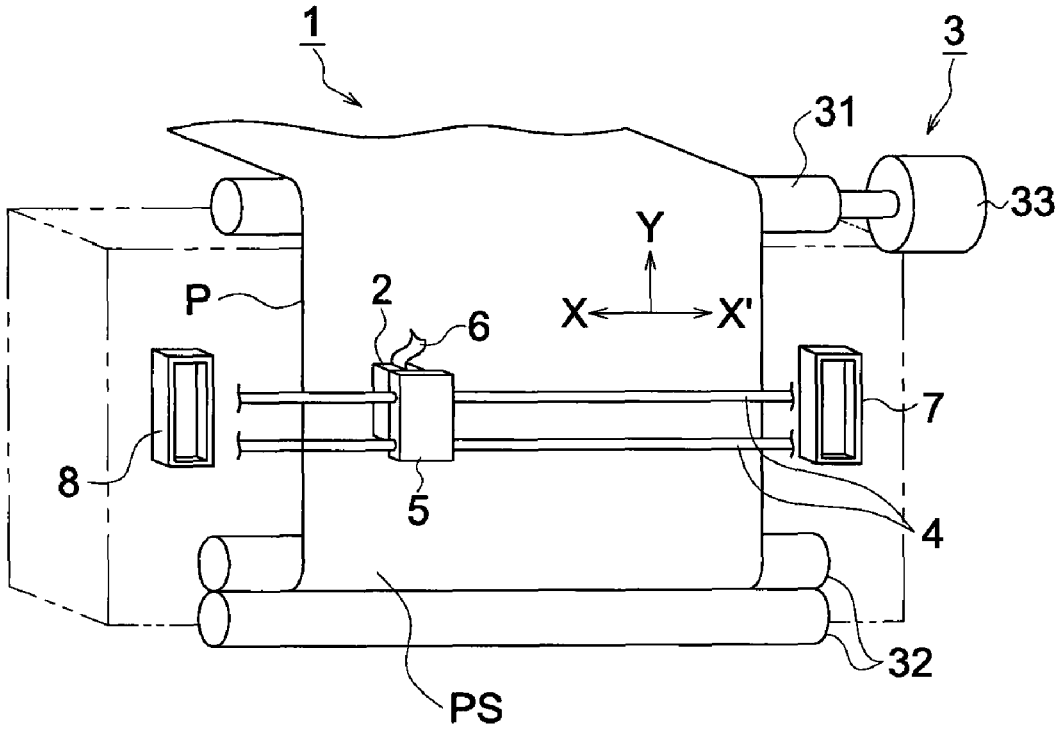
FIG. 1 shows the schematic structure of the inkjet recording apparatus.

FIG. 1 shows the schematic structure of the inkjet recording apparatus used in the liquid droplet ejecting apparatus of this invention. In the inkjet recording apparatus 1, the recording medium P is nipped in the conveyance roller pair 32 of the conveyance mechanism, and then conveyed in the Y direction of the drawing by the conveyance roller 31 that is driven by rotation using the conveyance motor 33.

The recording head 2 is provided so as to oppose the recording surface PS of the recording medium P. This recording head 2 is loaded onto the carriage 5 so that the nozzle surface side opposes the recording surface PS of the recording medium. The carriage 5 is provided along the guide rail 4 that extends along the width direction of the recording medium P so as to be moveable back and forth in the X-X' direction in the drawing (main scanning direction) which is substantially perpendicular to the conveyance direction (sub-scanning direction) of the recording medium P by a driving unit that is not shown. The recording head 2 is electrically connected via a flexible cable 6 to the drive pulse generating unit 100 (See FIG. 3) which has a circuit for generating the drive pulse.

The inkjet recording apparatus 1 comprises a control section and a memory section (not shown). The control section is the site which controls the entire inkjet recording apparatus 1 and may for example be a microcomputer comprising a CPU (central processing unit); a memory for storing programs; and a memory for temporarily storing information required for processing. The control section performs prescribed processing by executing the programs stored in memory.

The drive pulse generating unit 100 performs driving by applying a drive pulse to the pressure applying section such a the piezoelectric elements and the like which are in the pressure chambers of the recording head 2, in order to eject liquid droplets from the nozzle based on instructions from the control section.

Figure 4:
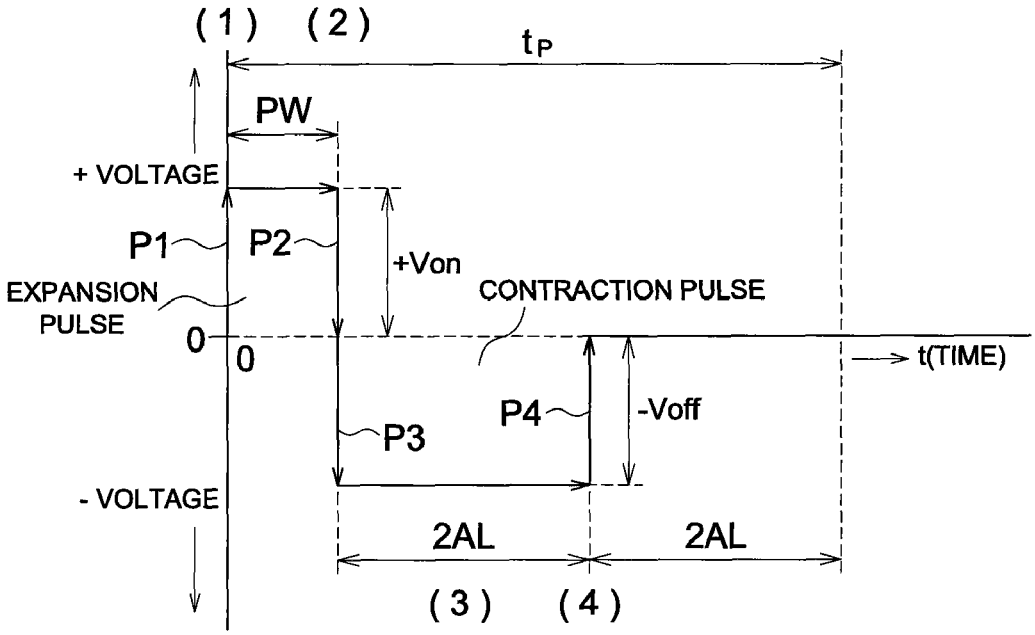
FIG. 4(*a*) shows the waveform of the drive pulse and FIG. 4(*b*) is the waveform showing the pressure changes of the pressure chamber when the expansion pulse is applied.
Figure 4:
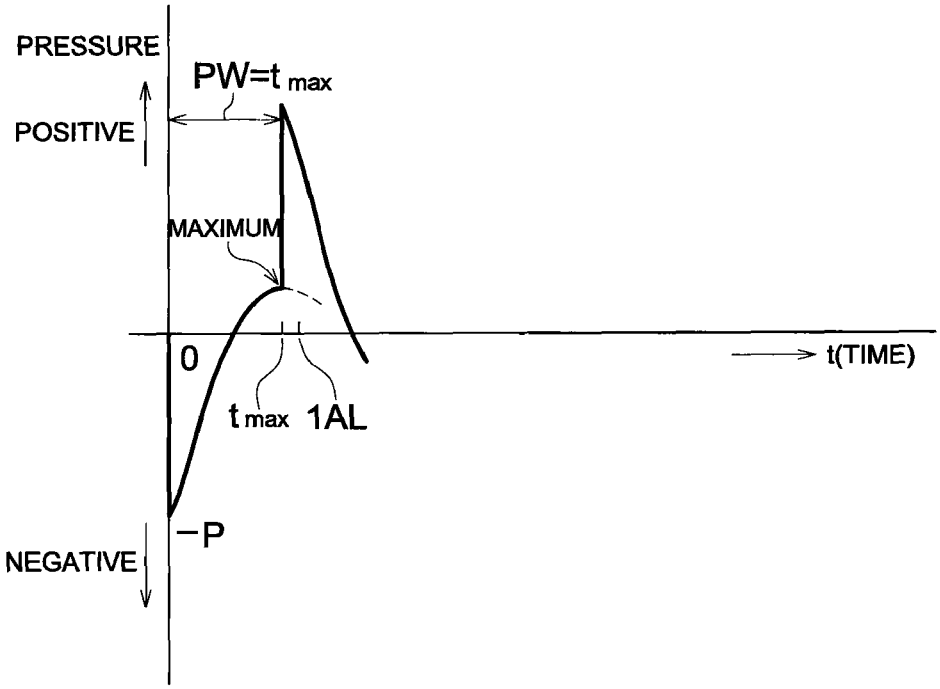

The drive pulse comprises the rectangular expansion pulse which causes contraction after the volume of the pressure chamber is expanded, and a rectangular contraction pulse which causes expansion after the volume of the pressure chamber is contracted following application of the expansion pulse (see FIG. 4(*a*)). The pulse width PW of the expansion pulse is set to satisfy the following equation (1) where the acoustic resonance frequency in the pressure chamber is f and the time constant for damping of the pressure wave is τ.

[Equation 3]

$$PW = \frac{\pi - \left(\tan^{-1}\frac{1}{2\pi f \tau}\right)}{2\pi f} \tag{1}$$

The memory section is a memory medium which stores data such as the pulse width PW of the expansion pulse and may take any form such as a readable and writable memory comprising semiconductor memory and the like or a memory device such as a magnetic disk device or the like.

The memory head 2 moves in the X-X' direction of the drawing on the recording surface PS of the recording media P with the movement of the carriage 5 and prescribed inkjet images are recorded by this movement process due to ink droplets being ejected.

It is to be noted that 7 is the ink receiver and the recording head 2 is provided at a waiting position such as the home position when no recording is being done. When the recording head is at this waiting position and is not in operation for a long period of time, the surface of the nozzle of the recording head 2 can be protected by being covered with a cap. 8 is also an ink receiver that nips the recording media P and is provided at a position opposing the ink receiving device 7 and when recording is done back and forth in both directions, when the switch is made between the forward movement and the backward movement, the flown ink droplets are received in the same manner as above.

The liquid droplet ejecting apparatus and liquid ejecting method of this invention may use any type of liquid droplet ejecting head provided that the liquid droplet ejecting head comprises: a nozzle for ejecting the liquid droplets; a pressure chamber that communicates with the nozzle; and a pressure applying section which changes the pressure of the pressure chamber by expanding or reducing the volume of the pressure chamber. Also, any liquid may be used to fill the pressure chamber. A shear mode type recording head 2 which is a liquid droplet ejection head using ink as the liquid for filling the pressure chamber is used in the following description.

In the shear mode type recording head, the partition walls of the pressure chamber are formed of a piezoelectric element which is the pressure applying section and ink is ejected from the nozzle by subjecting the piezoelectric element to shear deformation.

Figure 2:
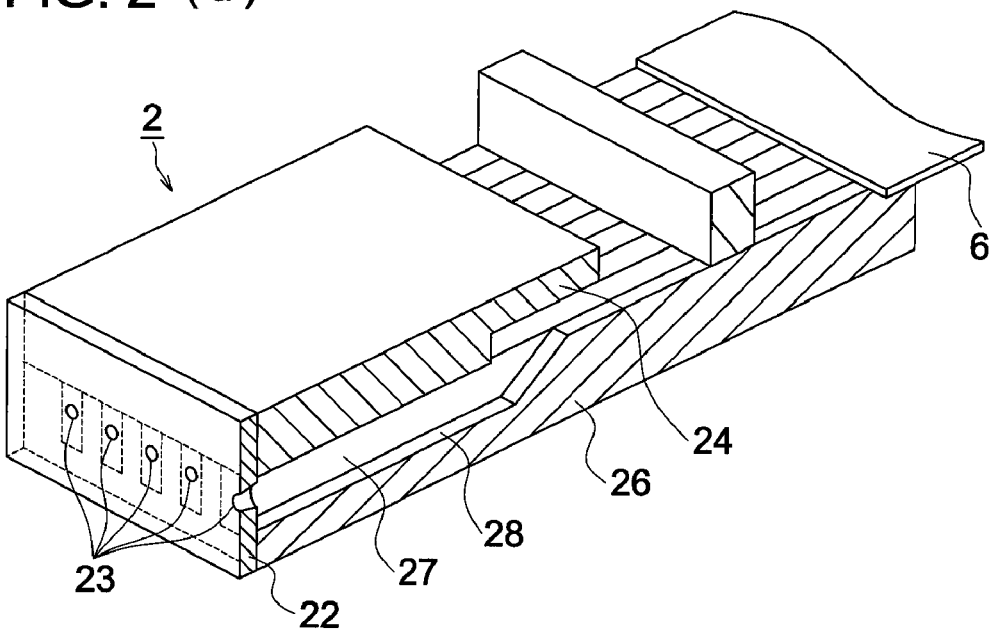
FIGS. 2(*a*) and 2(*b* show the schematic structure of the shear mode type recording head which is one aspect of the liquid droplet ejecting head and specifically, FIG. 2(*a*) is a perspective view of a partial cross section while FIG. 2(*b*) is a cross-sectional view of the state where the ink supply section is loaded.
Figure 2:
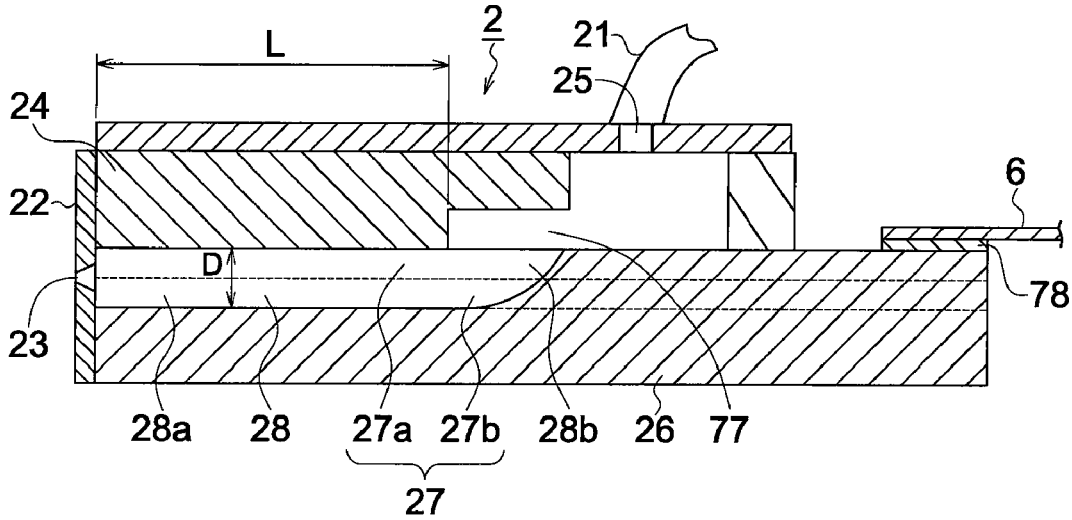

FIG. 2(*a*) and FIG. 2(*b*) show the schematic structure of the shear mode type recording head which is one aspect of the liquid droplet ejecting head and FIG. 2(*a*) is a perspective view of a partial cross section while FIG. 2(*b*) is a cross-sectional view of the state where the ink supply section is loaded.

It is to be noted that all of the pressure chambers have the same structure so the alphabet characters for indicating the structure are not included for the individual pressure chambers and sometimes indicate all of them.

Figure 3:
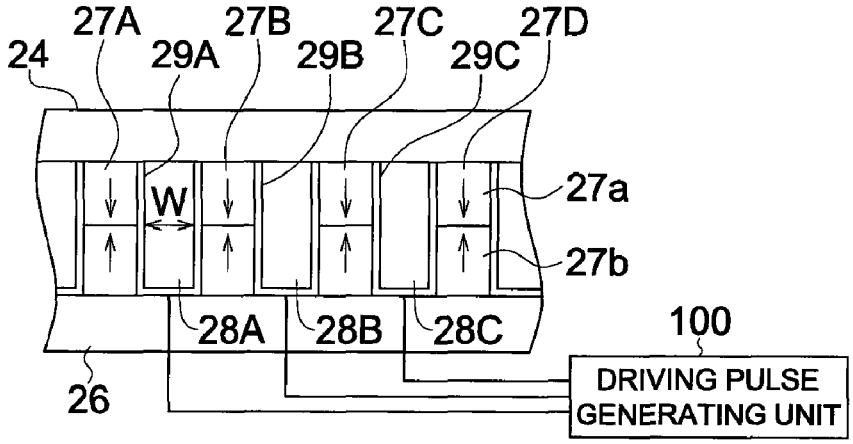
FIGS. 3(*a*)-3(*c*) show the operation of the recording head.
Figure 3:
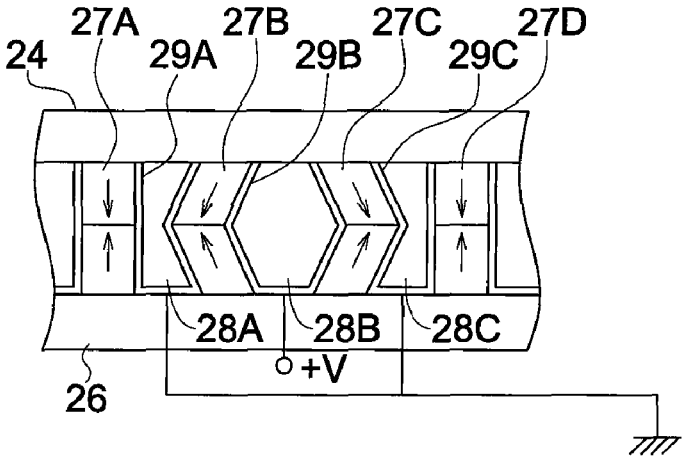
Figure 3:
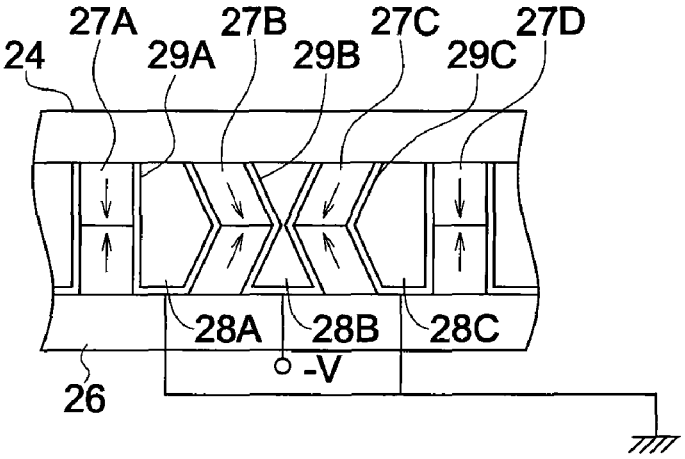

FIGS. 3(*a*)-3(*b*) show the operation of the recording heads.

In FIGS. 2(*a*) and 2(*b* and FIGS. 3(*a*) and 3(*b*), 2 is a recording head, 21 is an ink tube, 22 is a nozzle forming member, 23 is a nozzle, 24 is a cover plate, 25 is an ink supply port, 26 is a base plate, 27 is a partition wall, L is the length of the pressure chamber, D is the depth of the pressure chamber, and W is the width of the pressure chamber. In addition, the pressure chamber 28 comprises the partition walls 27, the cover plate 24 and the base plate 26.

As shown in FIG. 3(*a*) and FIG. 3(*b*), the recording head 2 is the shear type recording head in which there are a plurality of the pressure chambers 28 that are partitioned between the cover plate 24 and base plate 26, by a plurality of partition walls 27A, 27B, 27C, and 27D which are formed from a piezoelectric material such as PZT. In FIG. 3(*a*) and FIG. 3(*b*), 3 pressure chambers (28A, 28B, and 28C) which are some of the multiple pressure chambers 28 are shown. The end of the pressure chamber 28 (sometimes called nozzle end hereinafter) is connected to the nozzle 23 that is formed on the nozzle forming member 22, and the other end (sometimes called manifold end) is connected via the ink supply port 25 to the ink tank (not shown) by the ink tube 21. In addition, the electrodes 29A, 29B, and 29C which hang from the top of both partition walls 27 to the bottom surface of the base plate 26 are densely formed on the upper surface of the partition walls 27 inside each pressure chamber 28 and each of the electrodes 29A, 29B, and 29C are connected to the drive pulse generating unit 100.

Next, the method for manufacturing the recording head 2 and component materials will be described.

Two sheets of piezoelectric material 27*a* and 27*b* are vertically bonded onto the base plate 26 such that the polarization directions are opposite of each other and a diamond blade or the like is used to cut from piezoelectric material 27*a* which is the upper side, parallel multiple grooves with the same configuration to form the pressure chambers 28. As a result, the adjacent pressure chambers 28 are partitioned by the side walls 27 that are polarized in the direction of the arrow. Also, the pressure chamber 28 comprises a deep groove portion 28 of the outlet port side (left side in FIG. 2) of the pressure chamber 28 and a shallow groove portion which gradually becomes shallow as the inlet port side (right side in FIGS. 2*a* and 2*b*) is approached from the deep groove portion 28*a*.

Each partition wall 27 herein is formed from two sheets of piezoelectric materials 27*a* and 27*b* which have opposite directions of polarity as shown by the arrows in FIG. 3, but the piezoelectric member should be at least one portion of the partition wall and may be only the 27*a* portion for example.

There are no particular limitations on the piezoelectric material used for the piezoelectric material 27*a* and 27*b* provided that deformation is generated when voltage is applied, and known piezoelectric materials may be used. A base plate that is formed from organic material may be used, but a piezoelectric non-metal material is preferable. Examples of the base plate formed from a piezoelectric non-metal material include a ceramic base plate that is molded by processes such as molding, baking and the like, or a base plate molded by processes such as coating and lamination. Examples of organic materials include organic polymers and hybrids of organic polymers and inorganic substances.

Examples of the ceramic base plate include, PZT ($PbZr0_3$-$PBTiO_3$) third component additive PZT and examples of the third component include $Pb(Mg_{1/3}Nb_{2/3})O_3$, $Pb(Mn_{1/3}Sb_{2/3})O_3$, $Pb(Co_{1/3}Nb_{2/3})O_3$ and the like. In addition, $BaTiO_3$, ZnO, $LiNbO_3$, $LiTaO_3$ and the like may be used to form the base plate.

Examples of the base plate formed by processes such as coating and lamination include those formed by the sol-gel method, laminated base plate coating and the like.

A cover plate 24 that is bonded to the upper surface of the piezoelectric material 27*a* using adhesive, so as to extend along all the pressure chambers 28 and cover the deep groove portion 28*a*, and an ink inlet port 77 to the inside of the pressure chamber 28 are formed on the shallow groove 28*b* of the pressure chambers 28.

After bonding of the cover plate 24, one nozzle forming member 22 in which the nozzle 23 is provided, is bonded using adhesive. As shown in FIG. 2*b*, the nozzle 23 of the present embodiment has a tapered configuration in which the diameter at the ink outlet port side is smaller that the diameter at the ink inlet port side of the nozzle.

The nozzle diameter refers to the diameter of the front end opening portion at the ink outlet side of the nozzle, and in the case where the cross-section of the opening portion is circular it is the diameter of the cross section. It is to be noted that the shape of the cross section of the nozzle does not have to be circular and the cross-section may have other shapes such as polygonal or star-shaped. It is to be noted that in the case where the cross-section is not circular, the nozzle diameter is the diameter of a circle with the same surface area as the cross sectional area.

No particular limitations are imposed on the material that can be used for the cover plate 24 and the base plate 26, and a base plate may be formed from an organic material but it is preferably formed from a non-piezoelectric non-metal material and the non-piezoelectric non-metal material is preferably at least one selected from alumina, aluminum nitride, zirconia, silicon, silicon nitride, silicon carbide, quartz, and non-polarized PZT. Examples of the organic material include organic polymers and hybrids of organic polymers and inorganic substances.

In addition, examples of the material used for forming the nozzle forming member include synthetic resins such as polyimide resin, polyethylene naphthalate resin, crystal polymers, aromatic polyamide resin, polyethylene naphthalate resin, polysulfone resin, as well as metal materials such as stainless steel and the like.

A metal electrode 29 is formed inside each pressure chamber 28 to extend from both side surfaces to the bottom surface thereof, and the metal electrode 29 extends to the rear side surface of the piezoelectric member 27*a* through the shallow portion 28*b*. A flexible cable 6 is bonded to each of the metal electrodes 29 via the anisotropically conductive film 78 on the rear side surface and the side wall 27 is subjected to shear distortion by applying drive pulses from the drive pulse generating unit 100 to the metal electrodes 29 and the pressure at the time of deformation causes the ink inside the pressure chamber to be ejected from the nozzle 23 that is formed on the nozzle plate 22.

Examples of the metal used to form the metal electrode 29 include platinum, gold, silver, copper, aluminum, palladium, nickel, tantalum, titanium, and gold, aluminum, copper, and nickel are preferable in view of conductive and processing properties and the electrodes are formed by plating, vapor deposition, or sputtering.

As described above, in the shearing mode type recording head 2, pressure chambers 28 are formed on the piezoelectric materials 27*a* and 27*b* and by merely forming the metal electrodes 29 on the side walls thereof, the main portion of the head can be formed and thus, manufacturing is simple and because multiple pressure chambers 29 are arranged with a high density, this is a favorable form as high resolution image recording can be performed.

Next the ejection operation will be described.

When a drive pulse is applied from the drive pulse generating unit 100 to the electrodes 29A, 29B, and 29C that are densely formed on the surface of the partition walls 27, ink droplets are ejected from the nozzle 23 due to the operation used as an example in the following. It is to be noted that the nozzle was not included in FIG. 3.

It is also to be noted that as described above, in the recording head 2, positive and negative pressure is exerted on the ink inside the pressure chamber 28 due to deformation of the partition wall 27 and the partition wall 27 comprises the pressure applying section.

FIG. 4(*a*) shows the drive pulse in the liquid droplet ejection method of an embodiment of this invention and FIG. 4(*b*) is the waveform showing the pressure changes of the pressure chamber when the expansion pulse of FIG. 4(*a*) is applied. In FIG. 4(*b*), the X-axis is time and Y-axis is pressure.

(1) As shown in the state of FIG. 3(*a*), in the head 2, when the electrode 29A and the electrode 29C are grounded and a rectangular wave expansion pulse (positive voltage) in which the pulse width PW is set to satisfy (1) is applied to the electrode 29B, an electric field is generated that is at right angles to the polarization direction of the piezoelectric materials 27*a* and 27*b* which forms the partition walls 27B and 27C due to the first rise of the pulse (P1). Shift deformation of the joining surface of 27*a*, 27*b*, and the partition wall occurs and as shown in FIG. 3(*b*), the partition walls 27B and 27C both deform toward the outer side and the volume of the pressure chamber 28B expands. As a result, negative pressure −P which is lower than the normal pressure is generated in the ink inside the pressure chamber 28B and the ink is drawn.

It is to be noted that as described above, AL (Acoustic Length) is ½ of the acoustic resonance cycle Tc of the pressure chamber. The AL is 1/(2 f) and is obtained by measuring the acoustic resonance frequency f of the pressure wave in the pressure chamber. The method for measuring the acoustic resonance frequency f of the pressure wave will be described hereinafter.

The pulse is the rectangular wave of the fixed high voltage wave and in the case where 0V is 0% and the high voltage wave is 100%, the pulse width is defined as the time between the point of 10% of voltage of 0V from the start of voltage rise or the start of voltage fall and the point of 10% of the high voltage wave from the start of voltage rise or the start of voltage fall. Furthermore, the rectangular wave herein indicates a waveform such that the rise time is between 10% and 90% of voltage, and all the rise times are preferably less than ½ AL and more than ¼ AL.

(2) The negative pressure is transmitted to the pressure chamber with damping and after normal pressure returns, it inverts to positive pressure and the maximum (peak) positive pressure at $t_{max}$, which is from the first application of P1 to the point before 1 AL time elapses, is reached. Thus at this point, when the potential returns to 0 (P2), the partition walls 27B and 27C return from the expansion position to the middle position shown in FIG. 3*a* and a high pressure is exerted on the ink inside the pressure chamber 28B.

Next, the contraction pulse (negative voltage) comprising rectangular wave is applied. First, as shown in FIG. 3(*c*), due to the rise (P3) of the contraction pulse, the partition walls 27B and 27C deform in directions opposite to each other and the volume of the pressure chamber 28B contracts. As a result of this contraction, an even higher pressure is reinforced on the ink in the pressure chamber 28B, and an ink column projects from the opening of the nozzle 23.

(3) When 1 AL time elapses, the pressure wave of the ink inside the pressure chamber 28 inverts to negative pressure.

(4) Furthermore, when 1 AL time elapses, the pressure wave inverts to positive pressure and thus the potential returns to 0 (P4) and when the partition walls 27B and 27C return from the middle position to the contraction position, the volume of the pressure chamber 28B expands. The pressure wave due to the negative pressure of this expansion and the pressure wave of the positive pressure have a phase gap of 180° and thus they are offset and cancelled and the pressure wave dampens quickly. After this, the ink column separates and the separated ink flies off as ink droplets.

Due to this series of operations, a portion of the ink inside the pressure chamber 28B flies from the nozzle 23 as ink droplets.

As described above, by setting the pulse width of the expansion pulse PW so as to satisfy equation (1), the negative pressure generated at the time of the expansion pulse rises (P1), propagates the pressure chamber, and inverts to a positive pressure and then the maximum positive pressure is reached at $t_{max}$ (<1 AL) and at the same time, the positive pressure generated by contraction of the pressure chamber due to the rise of the expansion pulse (P2) and the fall of the contraction pulse (P3) is applied and these pressures depend on each other to obtain efficient ejection force. As a result, this has the advantage that the ink droplet ejection speed is fast.

In the case where the pulse width of the expansion pulse is set to 1 AL as is the case in the prior art, in the region where the positive pressure passes the maximum (peak) and is decreasing (dotted line in FIG. 4(*b*)), contraction occurs due to the rise of the expansion pulse (P2) and ejection efficiency is reduced.

In addition, in the present embodiment, the pulse width of the contraction pulse is 2 AL and thus the pressure wave is cancelled and it becomes possible for driving to occur in a shorter cycle.

As shown in FIG. 4(*a*), the drive pulse tp is such that if the expansion pulse time is PW, the subsequent contraction pulse time is 2 AL and the earth potential time until the next drive pulse is 2 AL, and 1 drive pulse or 1 cycle is complete in the total time of PW+(2+2)AL. It is to be noted that the earth potential time does not have to be 2 AL, and may be suitably set.

In addition, in the drive pulse of FIG. 4(*a*), the proportion of the drive voltage Von (V) of the expansion pulse to the drive voltage Voff (V) of the contraction pulse is preferably $|Von| \geqq |Voff|$. When the relationship is such that $|Von| \geqq |Voff|$ in this manner, it has the effect of speeding up the supply of ink to the pressure chamber and this relationship is preferable particularly in the case where high frequency driving of high viscosity ink is performed. It is to be noted that the reference voltage of voltage Von and voltage Voff does not have to be 0. The voltage Von and voltage Voff is the voltage difference between the respective reference voltages.

In the shear mode type inkjet head, the deformation of the partition wall 27 occurs due to the voltage difference applied to the electrodes provided at both sides of the wall. As a result, instead of negative pressure being applied to the electrodes in the pressure chamber which eject ink, the electrodes of the pressure chamber which eject ink are grounded and thus even if positive voltage is applied to the electrodes of adjacent pressure chambers, they can operate in the same manner. According to the latter method, driving can be done using only positive voltage and this is favorable in view of power source cost.

Next, time share driving which is an example of the liquid droplet ejection method of an embodiment of the present invention will be described.

In the case of driving of the head 2 comprising a plurality of pressure chambers partitioned by partition walls 27 in which at least a portion thereof is formed of a piezoelectric material, when the partition walls of one pressure chamber 28 performs the ejection operation, because the adjacent pressure chamber 28 is affected, drive control is normally performed by forming one group from among the multiple pressure chambers of the pressure chamber 28 that sandwich one or more of each other and are separate, and then they are divided into two or more groups and the ink ejection operation is sequentially performed for each group by time sharing.

That is to say, n pressure chambers are grouped into m units where a unit is a prescribed plurality and 1 pressure chamber of each unit is driven on a cycle of a time interval tp and n pressure chambers are driven in m cycles. The base cycle T is then formed using the encoder pass D and the carriage is moved back and forth and images are recorded on the recording medium by repeating the base cycle T.

Figure 5:
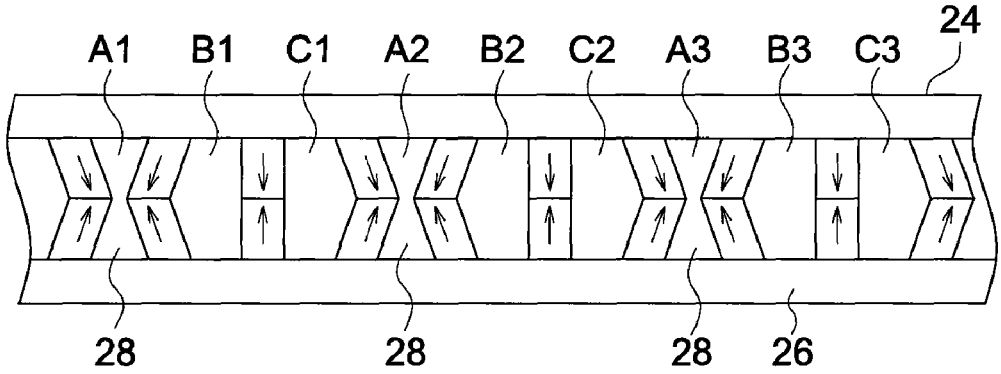
FIG. 5(*a*)-5(*c*) are explanatory drawings for the time-shared driving of the recording head.
Figure 5:
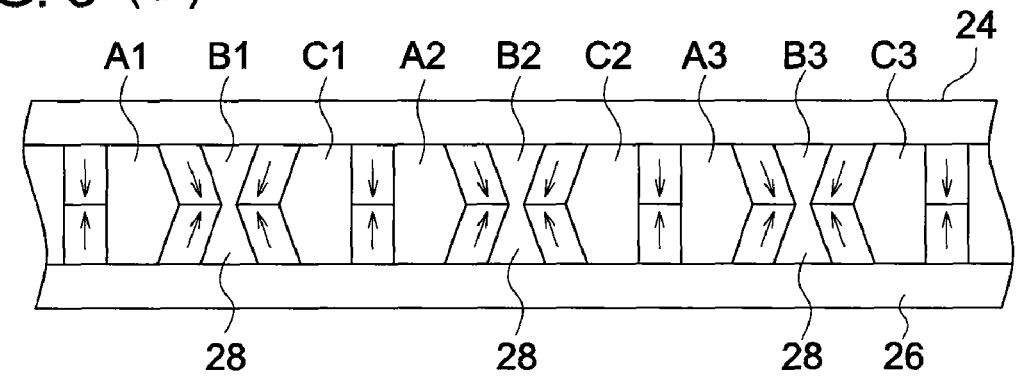
Figure 5:
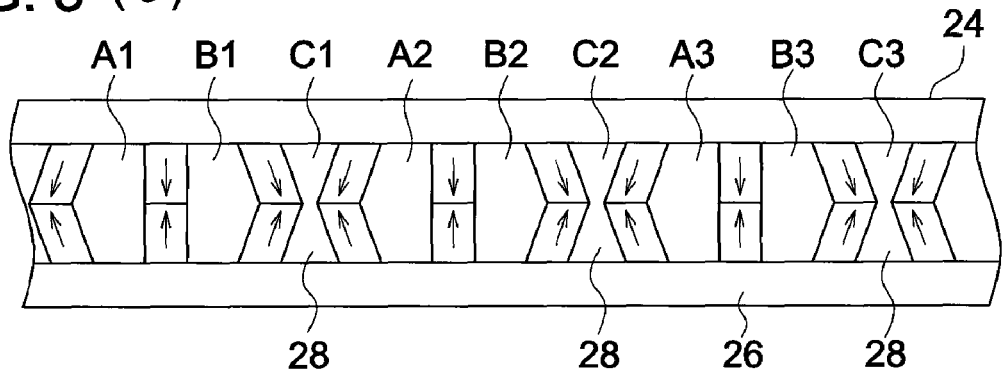
Figure 6:
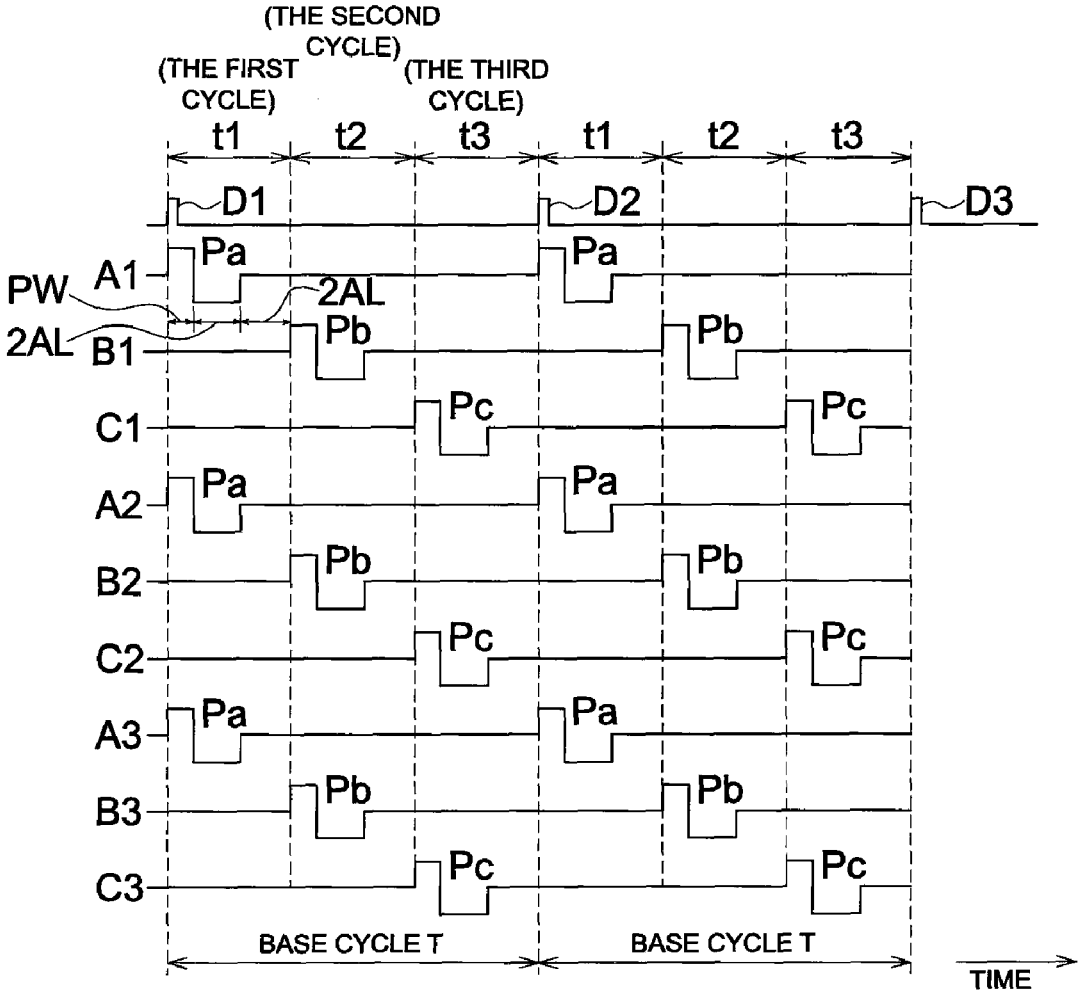
FIG. 6 is the timing chart of the driving pulse that is applied to the electrode of the pressure chamber in each of the phases A, B, and C.

The ejection operation in which m=3 and n=9 will be described further using FIGS. 5(*a*)-5(*c*) and FIG. 6. In the example shown in FIGS. 5(*a*)-5(*c*), the head comprises 9 pressure chambers which are A1, B1, C1, A2, B2, C2, A3, B3 and C3, and the case where driving is done by the drive pulse in FIG. 4(*a*) will be described herein. The timing chart of the drive pulse that is applied to the electrodes of the pressure chamber 28 groups A, B, and C at this time are shown in FIG. 6. In FIG. 6, the pressure chambers A1-C3 are shown on the Y axis and the time is shown in the X-axis.

As shown in FIG. 6, when driving is done by first applying the drive pulse Pa of the first cycle t1 simultaneously to the 3 pressure chambers A1, A2, and A3, the side walls of these 3 pressure chambers A1, A2, and A3 change simultaneously and ink droplets are ejected from each nozzle. As described above, the first volume of the pressure chamber that ejects the ink droplets expands and then suddenly the volume contracts. FIG. 5 shows the state where all of the pressure chambers contract. As shown in FIG. 6, when driving is done by applying the drive pulse Pb of the second cycle t2 simultaneously to the 3 pressure chambers B1, B2, and B3 as is the case below, and then driving is done again by applying the drive pulse Pc of the third cycle t3 simultaneously to the 3 pressure chambers C1, C2, and C3, the side walls change successively, and in the three cycles t1, t2, and t3, one round of driving the pressure chambers is done and all of the 9 pressure chambers are driven and the ink droplets are ejected. Pa, Pb, and Pc are the same drive pulse and they use the drive pulse shown in FIG. 4(*a*) and t1, t2, and t3 are set to be equal to the cycle tp of FIG. 4(*a*).

All of the pressure chambers are not always actually driven as described above, and sometimes only selected pressure chambers are driven to eject ink droplets to form images.

As described above, the inventors discovered that it was possible to supply a liquid droplet ejecting apparatus and a liquid droplet ejecting method capable of ejecting liquid droplets using more effective driving by setting pulse width PW of the expanding pulse to satisfy the equation (1) given that the acoustic resonance frequency of the pressure wave in the pressure chamber is f and the time constant for damping of the pressure wave in the pressure chamber is $\tau$. The details are described in the following.

As mentioned above, the negative pressure −P generated in the pressure chamber by the rising of the expansion pulse (P1) increases in pressure with the passage of time and after it returns to normal pressure, it inverts to positive pressure and then rises above normal pressure. After reaching the maximum positive pressure, pressure decreases and it returns to normal pressure and these pressure changes are repeated. At this time, the amplitude of the waveform that shows the pressure changes dampens in the form $e^{-t/}\tau$ which is the time t function (e is the base of the natural logarithm) and the coefficient of this function t become the time constant for the pressure wave.

Given that the acoustic resonance frequency of the pressure wave in the pressure chamber is f (1/sec); the time constant for damping of the pressure wave in the pressure chamber is $\tau$ (sec), time is t (sec), and the circumference ratio is $\pi$, the pressure change P(t) is shown by equation (2).

[Expression 4]

$$P(t) = -Pe^{-\frac{t}{\tau}}\cos 2\pi f t \tag{2}$$

It is to be noted that the acoustic resonance frequency of the pressure wave in the pressure chamber f can be measured by using a commercially available impedance analyzer to measure the impedance of the piezoelectric element of the recording head that is filled with ink and then obtaining f from the frequency for which the impedance of the piezoelectric element is reduced by resonance of the ink in the pressure chamber.

The damping time constant $\tau$ can be calculated based on equation (2) after measuring the pressure changes P(t) with respect to changes in time.

It is possible to obtain the damping time constant $\tau$ by measuring Q value of a resonance at a time when measuring the resonance frequency of the piezoelectric element with the impedance analyzer.

And it is also possible to measure the resonance period (resonance frequency) and the damping time directly by measuring vibrations of a meniscus caused by the pressure wave with a displacement gauge.

Given that the amount of phase shift due to damping of the pressure wave is $\alpha$ (rad), P' (t) which is derived from the above equation is shown by Equation 3.

[Expression 5]

$$P'(t) = Pe^{-\frac{t}{\tau}}\sqrt{(2\pi f)^2 + \frac{1}{\tau^2}}\sin(2\pi f t + \alpha) \tag{3}$$

Here $\alpha$ is shown by equation (4),

[Expression 6]

$$\alpha = \tan^{-1}\frac{1}{2\pi f \tau} \tag{4}$$

When the pressure wave reaches the maximum positive pressure,

[Expression 7]

$$\sin(2\pi ft+\alpha)=0 \tag{5}$$

equation (5) is satisfied and thus the time $t_{max}$ at this time, or in other words the pulse width PW is shown by equation 6.

[Expression 8]

$$t_{max} = PW = \frac{\pi - \alpha}{2\pi f} = \frac{\pi - \left(\tan^{-1}\frac{1}{2\pi f \tau}\right)}{2\pi f} \tag{6}$$

In this manner, the pulse width PW is a value that is determined based on the damping time constant of the pressure wave in the pressure chamber $\tau$ and the acoustic resonance frequency of the pressure wave f. In the case where there is absolutely no damping of the pressure wave, $\alpha$ is equal to 0 and thus as is evident from equation (6), PW=1/(2 f)=1 AL and this is not problematic in the prior art in which the expansion pulse width is set to 1 AL. However, the time constant of damping of the pressure wave $\tau$ is a unique value that is determined by the flow paths of the recording head, the dimensions of the nozzle, and the properties of the ink and propagation of the pressure wave in the pressure chamber always causes damping. As is evident from equation (6), the pulse width PW is short to the extent that damping is large, or in other words, to the extent that the damping time constant $\tau$ is small and the shift from 1 AL becomes marked. Consequently, the ink ejecting efficiency decreases. This means that the effects of the present invention are greater when the damping time constant $\tau$ is smaller, but if it is smaller than $8\times10^{-6}$ (sec), the effect of the damping time constant $\tau$ is too large and there is the possibility that this may cause an undesired increase in the drive voltage, and in the case where the damping time constant is between $8\times10^{-6}$ (sec) and $100\times10^{-6}$ (sec), the effects of the present invention are remarkable. If it is larger than $100\times10^{-6}$ (sec), PW will be almost the same value as for 1 AL.

In this manner, in order to increase the efficiency of ink ejection compared to that of the prior art in which the pulse width of the expansion pulse is set to 1 AL, the pulse width PW should be set so as to satisfy equation 1.

The pulse width PW that has been set in this manner is stored in the memory section of the inkjet recording apparatus 1. The control section of inkjet recording apparatus 1 reads the pulse width PW from the memory section and controls the drive pulse generating unit 100 and the recording head 2 so that the expansion pulse is generated with this pulse width and applied to the piezoelectric element of the recording head 2 and liquid droplets are ejected onto the recording medium P.

It is to be noted that the liquid droplet ejecting apparatus and liquid droplet ejecting method of the present invention exhibits a remarkable effect in the case where the viscosity depending on the ink temperature at the time of ejection is between 10 cp and 50 cp. This is because this type of ink has a high viscosity and the time constant of damping $\tau$ becomes small.

In addition, if the viscosity is too high, it is not easy for the ink to be smoothly ejected from the nozzle and thus driving voltage increases, so the ink velocity is preferably no greater than 50 cp.

The viscosity can be measured using an oscillating viscosity meter Model VM-1A-L (manufactured by Yamaichi Electronics).

In the embodiment described above, after the rectangular wave expansion pulse that is set so that the pulse width PW satisfies equation (1) and the volume of the pressure chambers are expanded by the drive pulse, the rectangular wave contraction pulse which causes contraction is applied immediately after. The drive pulse of the present invention is not limited to the drive pulse described above and may use any drive pulse provided that it has a rectangular expansion pulse set such that the pulse width PW satisfies equation (1).

In the above embodiment, the pressure applying section (partition wall) is formed from a piezoelectric element. In the liquid droplet ejecting apparatus and liquid droplet ejecting method, this case where the pressure applying section is formed from a piezoelectric element is preferable because it facilitates control by expanding the volume of the pressure chamber.

In addition, in the above embodiment, a rectangular drive pulse that has a rise time and drop time that are sufficiently shorter a than AL is applied. By using a rectangular wave, driving is performed that uses the acoustic resonance of the pressure wave more effectively. The ink droplets are ejected more efficiently than in the method that uses the trapezoid wave, and thus driving can be done with low drive voltage and the drive circuit can be designed using a simple digital circuit. In addition, there is the advantage that setting of the pulse width is easy.

In the above embodiment, a shear mode type piezoelectric element which deforms using the shearing mode due to application of an electric field is used as the pressure applying section. The shearing mode piezoelectric element is preferable because the rectangular drive pulse can be more effectively used and also because the drive voltage is reduced and more effective driving is possible.

The present invention is however, not to be limited by this embodiment, and for example a piezoelectric element having another form, such as a single plate type piezoelectric actuator or a longitudinal vibration type laminated piezoelectric element may be used. Also, electro-mechanical conversion elements that use electrostatic or magnetic force may be used.

In the description above, an inkjet recording apparatus was used as the example of the liquid droplet ejecting apparatus and a recording head for performing image recording was used as the liquid droplet ejecting head, but the present invention is not to be limited to these and the invention may have a wide range of uses as a liquid droplet ejection apparatus and liquid droplet ejection method which comprises a nozzle for ejecting the liquid droplets; a pressure chamber that communicates with the nozzle; and a pressure applying section which changes the pressure of the pressure chamber; and which ejects liquid in the pressure chamber as liquid droplets from the nozzle.

WORKING EXAMPLE

The effects of the present invention will be illustrated based on a working example.

First, a recording head was prepared under the following conditions. As shown in FIGS. 1-3, multiple grooves were formed in a base plate made of PZT to form the side walls and aluminum vapor deposited electrodes were formed on the side surfaces of each side wall. The recording head was formed by bonding a cover plate to the upper surface of each side wall using an adhesive and bonding it to the front end, a nozzle forming member (thickness 75 μm) into which a nozzle with a diameter of $\phi$20 μm and a taper angle of 6.3° is formed. The nozzle has a circular truncated cone shape and the taper angle of the nozzle is defined as ½ of the circular cone shape. And the length of the nozzle is equal to the thickness of the nozzle forming member.

The density of the pressure chambers was set at 180 dpi (141 μm pitch); the width W of each pressure chamber was 85 μm, the length L 5 mm, and the depth D 200 μm; the ink was a water based ink (viscosity 15 cp measured at 25° C.) and the surface tension was 40 dyne/cm measured at 25° C.

The acoustic resonance frequency of the pressure wave in the pressure chamber of the recording head f (kHz) was 74. 6 (kHz)=$74.6\times10^3$ (1/sec) and the damping time constant $\tau$ was $12\times10^{-6}$ (sec). These were measured by the method described above.

From the above, the acoustic resonance cycle Tc of the pressure wave was $13.4\times10^{-6}$ (sec) and AL was $6.7\times10^{-6}$ (sec).

Also, from equation (4) above $\alpha$=0.176 (rad) and from equation (6) PW=$6.3\times10^{-6}$ (sec).

As shown in FIG. 4(*a*) evaluation of the recording head was carried out by applying a driving pulse in which the proportion (|Von|/|Voff|) of the drive voltage Von (V) of the expansion pulse to the drive voltage Voff (V) of the contraction pulse (|Von|/|Voff|) is 1, at a voltage where the drive voltage is 8.3V, the pulse width PW of the expansion pulse is $6.3\times10^{-6}$ (sec) and the pulse width of the contraction pulse and the length of the earth potential are each 2 AL=$13.4\times10^{-6}$ (sec) to the electrodes. Ink droplets were ejected by the recording head being driven in 3 cycles (every 2 pressure chambers) by time sharing and then the ejection speed of 1 suitably selected nozzle was evaluated using the method below.

The ink droplet ejects 20 ink droplets continuously and the $20^{th}$ ink droplet is evaluated.

Measurement of ejection speed: The ink droplet speed at the point where the ink droplet had flown approximately 1 mm from the opening of the nozzle was measured by a strobe light measurement which uses a CCD camera.

COMPARATIVE EXAMPLE

The evaluation was done in the same manner as the working example except that the pulse width of the expansion pulse was set to 1 AL=$6.7\times10^{-6}$ (sec)

The measured ejection speed of the ink droplets was (m/sec) in the working example and 4.42 (m/sec) in the comparative example and this confirmed the effect of the present invention.

Table 1 shows the above described example of the present invention and comparative example (Example and Comparative example 1), and additional examples and comparative examples (Example and Comparative example 2-6).

TABLE 1

| Example and Comparative example | Channel Length mm | Nozzle Length μm | Ink viscosity mPa sec | *1 | AL μ sec | Damping time constant τ (μ sec) | α rad | tmax μ sec | Drive voltage Volt | Droplet ejection speed (PW = AL) m/sec | Droplet ejection speed (PW = tmax) m/sec |
|---|---|---|---|---|---|---|---|---|---|---|---|
| 1 | 5 | 75 | 15 | 74.6 | 6.7 | 12.1 | 0.175 | 6.3 | 8.3 | 4.42 | 4.55 |
| 2 | 5 | 75 | 3 | 81.3 | 6.2 | 27.5 | 0.085 | 6 | 6.2 | 7.16 | 7.21 |
| 3 | 5 | 75 | 10 | 78.1 | 6.4 | 15.9 | 0.127 | 6.1 | 8.3 | 6.52 | 6.55 |
| 4 | 5 | 75 | 20 | 71.4 | 7 | 10. | 0.211 | 6.5 | 12.4 | 6.57 | 6.7 |
| 5 | 5 | 50 | 15 | 81.3 | 6.2 | 8.9 | 0.213 | 5.7 | 11.1 | 7.83 | 7.91 |
| 6 | 10 | 75 | 15 | 35.7 | 14 | 13.6 | 0.317 | 12.6 | 9 | 6.5 | 6.82 |

*1: Resonance Frequency kHz

In the examples of the present invention, the ejection speed of ink droplets at the same drive voltage is larger than in the comparative examples and it is clear that the ejection efficiency of the ink droplets is improved. Conversely, by adjusting the drive voltage such that the ejection speed is the same, it becomes possible to lower the drive voltage.

What is claimed is:

1. A liquid droplet ejecting apparatus comprising:

a liquid droplet ejecting head; and a drive pulse generating unit adapted to generate a drive pulse, wherein the liquid ejecting head includes:

a nozzle which ejects liquid droplets;

a pressure chamber which communicates with the nozzle; and a pressure applying section which changes a pressure in the pressure chamber by expanding or reducing a volume of the pressure chamber, wherein the drive pulse generated by the drive pulse generating unit is applied to the pressure applying section so as to change the pressure in the pressure chamber and the change of pressure in the pressure chamber causes the liquid in the pressure chamber to be ejected from the nozzle, and wherein the drive pulse comprises a rectangular expansion pulse which causes expansion and then contraction of the volume of the pressure chamber and in which a pulse width PW of the expanding pulse is set so as to satisfy the following conditional equation, $$PW = \frac{\pi - \left(\tan^{-1}\frac{1}{2\pi f \tau}\right)}{2\pi f} \quad (1)$$

where f represents an acoustic resonance frequency of a pressure wave in the pressure chamber and τ represents a damping time constant of the pressure wave.

2. The liquid droplet ejecting apparatus described in claim 1, wherein the damping time constant τ is not less than $8\times10^{-6}$ (sec) and not more than $100\times10^{-6}$ (sec).

3. The liquid droplet ejecting apparatus described in claim 2, wherein the pressure applying section comprises a shear mode type piezoelectric element.

4. The liquid droplet ejecting apparatus described in claim 2, wherein the drive pulse further comprises a rectangular contraction pulse that follows the rectangular expansion pulse and causes contraction and then expansion of the volume of the pressure chamber.

5. The liquid droplet ejecting apparatus described in claim 4, wherein the pressure applying section comprises a shear mode type piezoelectric element.

6. The liquid droplet ejecting apparatus described in claim 1, wherein the drive pulse further comprises a rectangular contraction pulse that follows the rectangular expansion pulse and causes contraction and then expansion of the volume of the pressure chamber.

7. The liquid droplet ejecting apparatus described in claim 6, wherein the pressure applying section comprises a shear mode type piezoelectric element.

8. The liquid droplet ejecting apparatus described in claim 1, wherein the pressure applying section comprises a shear mode type piezoelectric element.

9. A method of ejecting liquid droplet from a nozzle of a liquid droplet ejecting apparatus having a nozzle which ejects liquid droplets, a pressure chamber which communicates with the nozzle, and a pressure applying section which changes a pressure in the pressure chamber by expanding or reducing a volume of the pressure chamber, the method comprising:

applying a drive pulse to the pressure applying section to change the pressure in the pressure chamber, thereby causing the liquid in the pressure chamber to be ejected from the nozzle, wherein the drive pulse comprises a rectangular expansion pulse which causes expansion and then contraction of the volume of the pressure chamber and in which a pulse width PW of the expanding pulse is set so as to satisfy the following conditional equation, $$PW = \frac{\pi - \left(\tan^{-1}\frac{1}{2\pi f \tau}\right)}{2\pi f} \quad (1)$$

where f represents an acoustic resonance frequency of a pressure wave in the pressure chamber and τ represents a damping time constant of the pressure wave.

10. The method described in claim 9, wherein the damping time constant τ is not less than $8\times10^{-6}$ (sec) and not more than $100\times10^{-6}$ (sec).

11. The method described in claim 10, wherein the drive pulse further comprises a rectangular contraction pulse that follows the rectangular expansion pulse and causes contraction and then expansion of the volume of the pressure chamber.

12. The method described in claim 11, wherein the pressure applying section comprises a shear mode type piezoelectric element.

13. The method described in claim 10, wherein the pressure applying section comprises a shear mode type piezoelectric element.

14. The method described in claim 9, wherein the drive pulse further comprises a rectangular contraction pulse that follows the rectangular expansion pulse and causes contraction and then expansion of the volume of the pressure chamber.

15. The method described in claim 14, wherein the pressure applying section comprises a shear mode type piezoelectric element.

16. The method described in claim 9, wherein the pressure applying section comprises a shear mode type piezoelectric element.

* * * * *